United States Patent [19]

Roenigk et al.

[11] Patent Number: 4,975,049

[45] Date of Patent: Dec. 4, 1990

[54] REFRACTORY BLOCK FOR ROTARY KILN

[75] Inventors: Howard L. Roenigk, Cabot, Pa.; Peter R. Frazier, Austintown, Ohio; Richard C. Lipp, Evans City, Pa.

[73] Assignee: General Refractories Company, Valley Forge, Pa.

[21] Appl. No.: 365,923

[22] Filed: Jun. 14, 1989

[51] Int. Cl.[5] ..... F27B 7/38

[52] U.S. Cl. ..... 432/118; 432/119

[58] Field of Search ..... 432/119, 103, 118

[56] References Cited

U.S. PATENT DOCUMENTS

| | | | |
|---|---|---|---|
| 1,524,033 | 1/1925 | Hawke . | |
| 1,936,635 | 11/1933 | Lee | 432/119 |
| 3,346,248 | 10/1967 | Martinet et al. | 432/119 |
| 3,520,094 | 7/1970 | Deynat | 432/119 |
| 4,295,825 | 10/1981 | Chielens et al. | 432/119 |
| 4,406,619 | 9/1983 | Oldengott . | |
| 4,437,415 | 3/1984 | Spielman . | |
| 4,569,659 | 2/1986 | Olsen et al. | 432/119 |

FOREIGN PATENT DOCUMENTS

| | | | |
|---|---|---|---|
| 1404772 | 6/1988 | U.S.S.R. | 432/119 |

*Primary Examiner*—Henry C. Yuen

*Attorney, Agent, or Firm*—Howson and Howson

[57] ABSTRACT

A refractory block assembly for the nose ring of a rotary kiln. Self-aligning nuts contained in recesses of a refractory casting generally align with bolts radially extending through holes spaced around the periphery of a retainer in the nose ring. The nuts and recesses are sized and configured to permit limited lateral and rotational displacement of the nut for threadingly engaging the bolts.

11 Claims, 2 Drawing Sheets

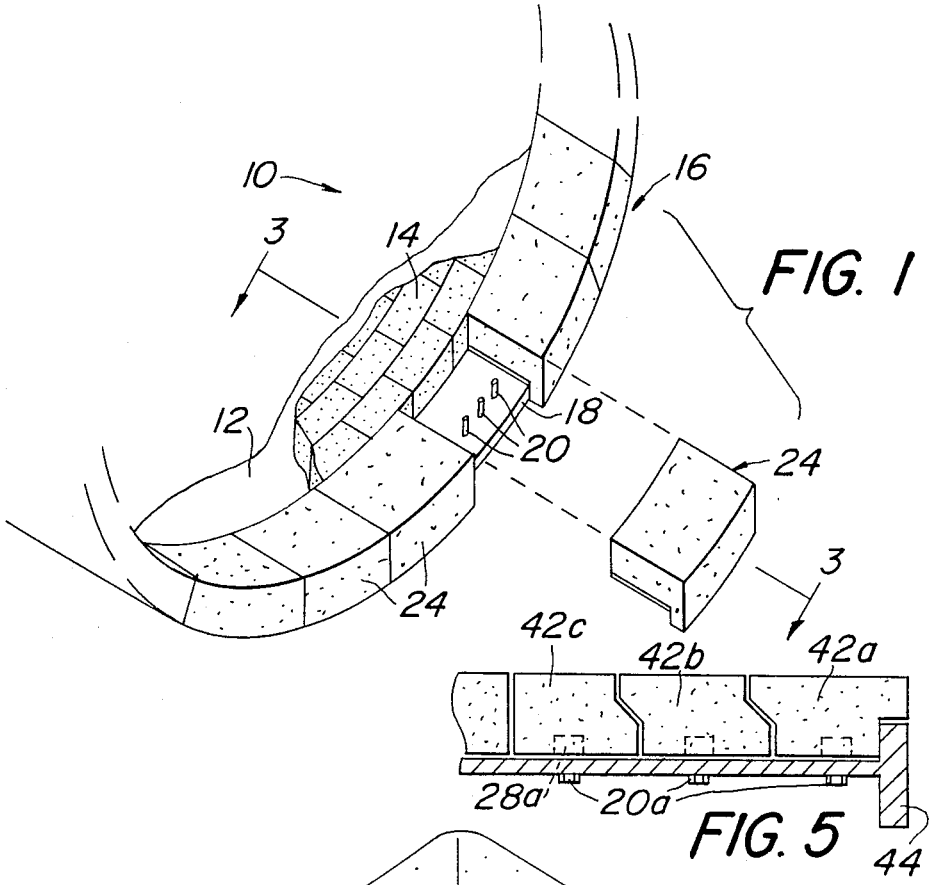
FIG. 1
FIG. 5
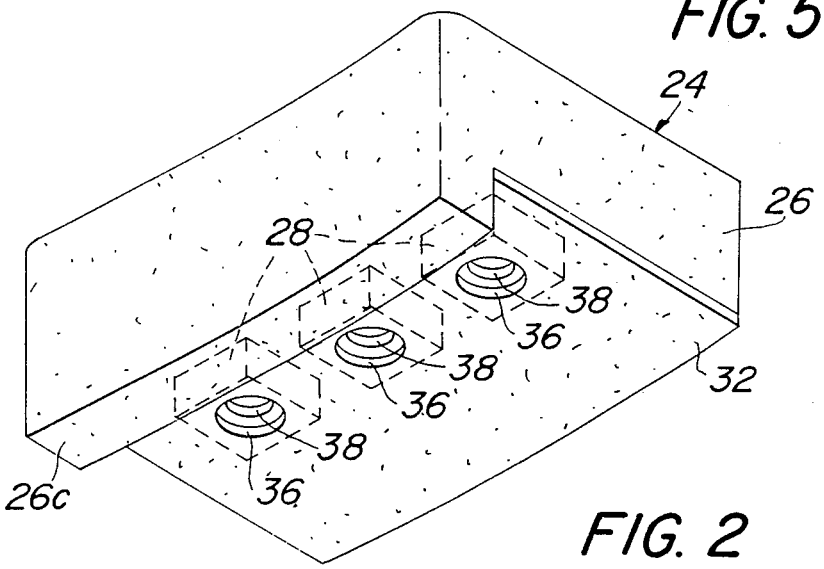
FIG. 2

FIG. 3
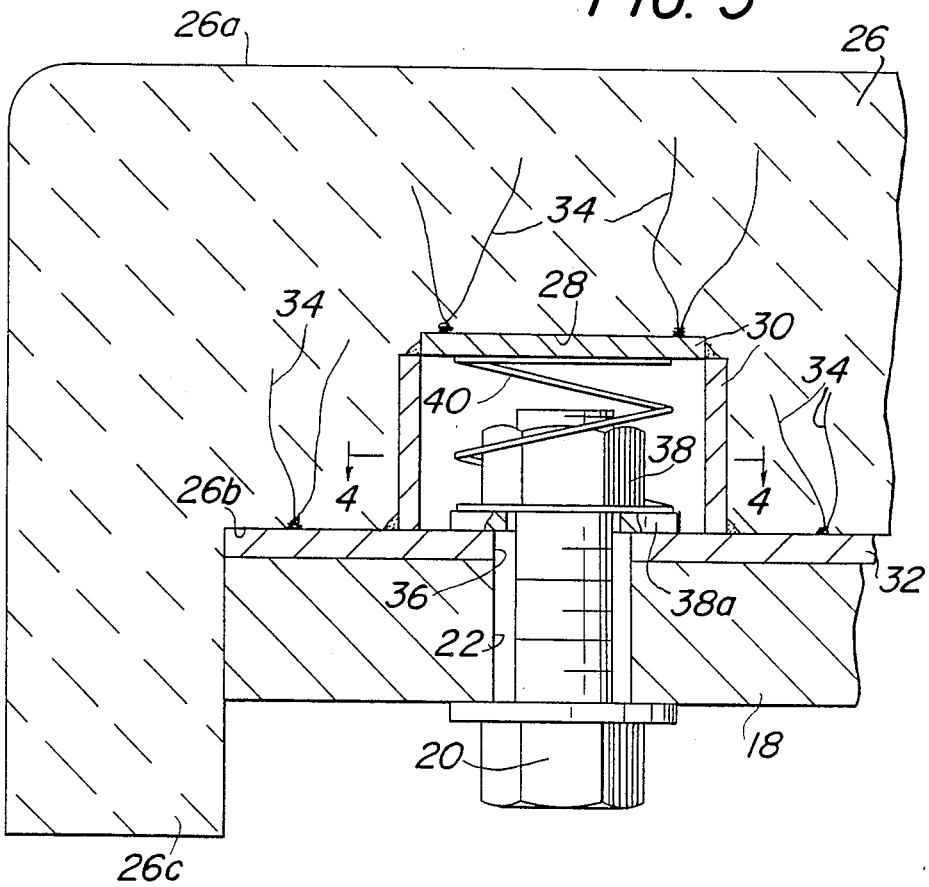
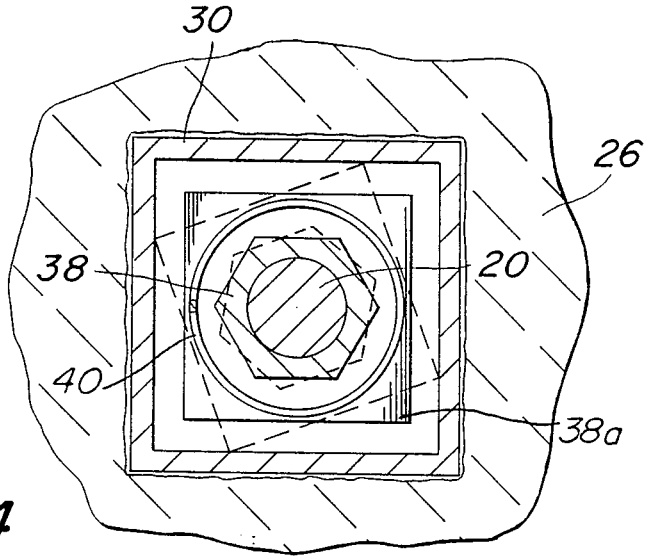
FIG. 4

REFRACTORY BLOCK FOR ROTARY KILN

BACKGROUND OF THE INVENTION

The present invention relates generally to rotary kilns and the like, and more particularly to a refractory block suitable for installation in the refractory lining of a rotary kiln.

Refractory material lining the interior steel shell of large rotary kilns, such as used in the production of cement and lime, is very difficult to hold in place due to warping of the shell, and is subject to much wear and erosion due to continuous abrasion of the hot materials being processed through the kilns. These conditions are especially prevalent at the discharge end or so-called nose of the kiln. Many rotary kilns employ a plastic refractory nose ring, fixed to the discharge end of the shell, in which extruded refractory material is pounded or rammed over anchors in a steel cylindrical retainer to form a monolithic structure. When a portion of the refractory material becomes worn, it is necessary to replace the entire ring usually with much effort and production downtime. For example, in one typical cement plant the operators required 72 to 80 hours to install a complete plastic refractory nose ring of this type.

Another form of rotary kiln nose ring consists of precast refractory blocks secured to the interior of a steel cylindrical retainer by bolts distributed around the periphery. In a new kiln, securing the blocks to the retainer is usually a simple procedure since everything is in proper alignment. However, with extensive use, the retainer warps and the blocks shift forcing the them out of alignment with the bolts. Replacing individual worn blocks therefore becomes very difficult and time-consuming. In some instances, though only a few blocks may need replacement, it is more cost-effective to replace the entire nose ring, as in the case of the monolithic nose ring, because the unworn blocks have shifted position.

SUMMARY OF THE INVENTION

Accordingly, it is an object of the present invention to provide an improved refractory block suitable for lining the interior surface of nose rings in rotary kilns.

Another object is to provide a novel precast refractory block suitable for individual replacement of worn refractory blocks lining the interior of the nose ring of a rotary kiln.

A further object is to provide a precast refractory block having self-aligning threaded holes for receiving bolts disposed around the nose ring of a rotary kiln.

Still another object is to provide a precast refractory block which reduces the downtime of a rotary kiln when repairing refractory therein, which permits selective replacement of worn refractory blocks in the nose ring of a rotary kiln, which is inexpensive to manufacture with state-of-the-art materials and processes, and which requires for installation in a rotary kiln no special keying or bolts extending from the cold face of the refractory block.

These objects and other aspects of the invention are accomplished by a refractory block having self-aligning nuts for fastening to bolts spaced around the circumference of a cylindrical retainer in the nose ring of a rotary kiln. Each nut is contained in a recess formed in the outer or cold side of a refractory casting. A base plate fixed to the cold side of the casting includes a central aperture at each recess for aligning and registering with one of the bolts radially extending through a hole in the retainer. The aperture is larger than the diameter of the bolt shank an amount sufficient to allow for any misalignment due to warping of the retainer. Each nut includes a flange urged by a compression spring into sliding contact with the interior surface of the base plate for threading onto the bolt extending through the aperture. The size and configuration of the flange relative to the recess, in a plane parallel to the base plate, allows the nut limited lateral and rotational motion over the aperture. Lateral and rotational manipulation of the bolt in the aperture against the nut will threadingly align the nut with the bolt and rotate the nut only until the flange interengages the sides of the recess. With further rotation of the bolt, it will thread into tight engagement with the nut and secure the refractory block to the nose ring retainer.

BRIEF DESCRIPTION OF THE DRAWINGS

For a better understanding of these objects, novel features and other aspects of the invention, reference is made to the following detailed description taken in conjunction with the accompanying drawings wherein:

FIG. 1 is a perspective view of a portion of the discharge end of a rotary kiln with a refractory block constructed according to the invention shown displaced from an installed position;

FIG. 2 is an enlarged isometric view of the refractory block of FIG. 1 viewed from its cold side;

FIG. 3 is a fragmentary cross section through the kiln taken along the line 3—3 of FIG. 1 with the refractory block shown in the installed position;

FIG. 4 is a cross section of a portion of the block taken along the line 4—4 of FIG. 3; and FIG. 5 schematically illustrates in partial cross section the discharge end of a rotary kiln with three courses of block of various shapes constructed according to the invention.

DESCRIPTION OF THE PREFERRED EMBODIMENT

Referring now to the drawings wherein like characters designate like or corresponding parts throughout the several views, there is shown in FIG. 1 a portion of the discharge end or nose of a rotary kiln 10 having an exterior heavy steel shell 12 with a cylindrical lining of refractory bricks 14 and a nose ring generally indicated by the reference number 16. Nose ring 16 includes a cylindrical steel retainer 18 concentrically attached to the end of shell 12, bolts 20 extending through holes 22 (FIG. 3), and a course of refractory blocks 24 forming a smooth interior with refractory bricks 14.

As better illustrated in FIGS. 2, 3 and 4, each block 24 includes a refractory casting 26 of arcuate interior "hot" and exterior "cold" surfaces **26*a* and 26*b* formed to be placed around the interior of retainer 18. Casting 26 also includes a lip 26*c* abutting the outer end of retainer 18; however, the particular shape of casting 26 can vary to suit the particular kiln configuration. Casting 26 further includes three generally square recesses 28 on the cold surface 26*b*. A metal box 30 lining the sides and bottom of each recess 28, and a metal base plate 32 covering the cold surface 26*b* are secured to each other, such as by welding, and casted in place to refractory 26 by embedment anchors 34 fixed to lining 30 and plate 32, such as by welding. Plate 32 defines three apertures 36 each centrally positioned to align with the bolt holes 22 associated with a given block 24. Sufficient clearance is provided in apertures 36 to allow for any misalignment of bolts 20 due to possible warping of retainer 18. Holes 22 in retainer 18 may also be larger than bolts 20** for further adjustability.

Each bolt 20 threadingly engages a nut 38 fixed to a square flange 38*a* facing the interior surface of base plate 32. A coil compression spring 40 around the sides of nut 38 and interposed between the bottom of recess 28 and flange 38*a* urges nut 38 into sliding contact with base plate 32. As best illustrated in FIG. 4, the distance across opposite sides of flange 38*a* is less than across corresponding interior sides of liner 30 thereby allowing nut 38 to slide laterally within recess 28. However, the distance across opposite corners of flange 38*a* is greater than across opposite sides of liner 30 thereby limiting rotation of nut 38 to less than one-quarter turn as bolt 20 is screwed into it. For example, with an aperture 36 allowing ¼" off-center displacement of the shank of bolt 20, a 2" square flange in a 2½" square metal box 30 provides as much lateral displacement of nut 38 with rotation limited to less than one-quarter turn. Other recess and nut sizes and configurations, in a plane parallel to base plate 32, are contemplated for achieving the limited lateral and rotational motion needed for self-alignment by nut 38 so long as they permit nut 38 to be manipulated with bolt 20 until nut 38 threadingly aligns therewith, rotates only until flange 38*a* interengages the sides of liner 30 and, upon further rotation of bolt 20, threads into tight engagement therewith. For example, both the recess and nut may be triangular or elliptical, or the recess and nut may even have shapes different from each other.

Referring to FIG. 5, intermeshing shapes 42*a*, 42*b*, and 43*b* of the courses of refractory block according to the invention are illustrated for installation in a retainer 44 of a nose ring. The shapes are secured by bolts 20*a*, like block 24 of FIGS. 1–4, and nuts (not shown) contained in recesses 28*a* as shown in dotted outline.

The manner in which a refractory block 24 is installed is summarized with reference to FIGS. 1–4 as follows. A block 24 is placed on the interior side of retainer 18 with apertures 36 aligned approximately with the associated holes 22 of retainer 18. The threaded shanks of bolts 20 are inserted through holes 22 and urged against nuts 38 causing them slide across aperture 36 in a direction necessary for threading alignment. Additional play for alignment of bolts 20 is provided by the clearance around plate apertures 36 and retainer holes 22. Once aligned, nuts 38 will turn with bolts 20 about one-quarter turn and until they engage the sides of liner 30 after which continued turning of bolts 20 will thread into nut 38 until tightly engaged with block 24 firmly secured to retainer 18.

Some of the many advantages and novel features of the invention should now be readily apparent from the foregoing description. For example, a refractory block is provided which is particularly suited for lining the interior of a nose ring of a rotary kiln. Worn refractory blocks can be individually replaced in a nose ring without removing or replacing the entire ring thereby minimizing labor costs and production downtime. Self-aligning fasteners within the refractory block enable installation on nose rings which have warped from extensive use, and the simplicity of the block design enables them to be manufactured at relative low cost with conventional materials.

It will be understood that various changes in the details, steps and arrangement of parts, which have been herein described and illustrated in order to explain the nature of the invention, may be made by those skilled in the art within the principle and scope of the invention as expressed in the appended claims.

We claim:

1. In an improved nose ring of a rotary kiln including a row of nose block secured around the inner surface of a cylindrical retainer by bolts spaced around and extending radially inward through the retainer, each of the blocks comprising, in combination:

a base plate having one side formed to be contiguously attached to the interior surface of the retainer, and including an aperture with sufficient clearance for receiving an adjacent one of the bolts;

a refractory casting fixed to the other side of said base plate, and including a recess communicating with said aperture; and a self-aligning nut within said recess of a size and configuration relative to said recess for permitting lateral and rotational play within selected limits over said aperture in a plane substantially normal to the length of said adjacent bolt for threading engagement thereof.

2. A nose block according to claim 1, further comprising:

a spring disposed between said recess and said nut for urging said nut into sliding contact with said base plate.

3. A nose block according to claim 1 further comprising:

a first anchor secured to said base plate and embedded in said refractory casting.

4. A nose block according to claim 1 further comprising:

a metal lining secured to the sides and bottom of said recess and to said other side of said base plate.

5. A nose block according to claim 4 further comprising:

second anchor means secured to said lining and embedded in said refractory casting.

6. A nose block according to claim 1 wherein:

said nut includes a flange contiguously contacting said base plate; and said spring defines a compression coil surrounding said nut and abutting said flange.

7. An improved refractory block assembly of the type fastened by a plurality of bolts spaced around a retainer in the nose ring of a rotary kiln, wherein the improvement comprises:

a plate having one side formed to be contiguously attached to the interior of the retainer, and apertures spaced in said plate for receiving respective ones of the bolts;

a refractory casting fixed to the other side of said plate, and including a recess of generally square shape adjacent to each of said apertures; and a nut within each of said recesses having a flange of generally square shape relatively smaller than said recess for permitting lateral and rotational motion within selected limits; and a coil compression spring connected between the bottom of said recess and said flange for urging said nut against said plate.

8. An improved refractory block assembly according to claim 7 wherein the improvement further comprises:

a metal lining secured to the sides and bottom of said recess and to the other side of said plate; and anchors fixed to said lining and said plate and embedded in said refractory casting.

9. A nose ring for a rotary kiln having an exterior cylindrical shell comprising, in combination:

a cylindrical metal retainer formed to be concentrically attached to the end of the shell and having circumferentially spaced holes;

bolts extending inwardly through said holes; and a plurality of nose blocks lining the inner surface of said retainer, said blocks each including a metal base plate with one side contiguous with the inner surface of said retainer and at least one aperture for receiving an adjacent one of said bolts with sufficient clearance for permitting misalignment thereof within a selected limit, a refractory casting fixed to the other side of said base with a recess communicating with said aperture, and a self-alogning nut within said recess of a size and configuration relative to said recess for permitting limited lateral and rotational play over said aperture in a plane substantially normal to the length of said adjacent bolt for threadingly engaging said adjacent bolt.

10. A nose ring according to claim 9 further comprising:

force exerting means disposed in said recess urging said nut along the thread axis thereof into sliding contact with said base.

11. A nose ring according to claim 10 wherein:

said nut includes a flange adjacent to said base; and said force exerting means includes a coil spring surrounding said nut in compression between said casting and said flange.

* * * * *